US006246926B1

(12) United States Patent
Ishii et al.

(10) Patent No.: US 6,246,926 B1
(45) Date of Patent: Jun. 12, 2001

(54) SHEET SORTING APPARATUS AND SHEET SORTING METHOD

(75) Inventors: Hirotomo Ishii; Atsushi Kondo, both of Amagasaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/350,922

(22) Filed: Jul. 12, 1999

(30) Foreign Application Priority Data

Jul. 13, 1998 (JP) ..... 10-196414
May 27, 1999 (JP) ..... 11-147609

(51) Int. Cl.[7] ..... B65H 31/22

(52) U.S. Cl. ..... 700/223; 271/288; 271/296; 271/298; 270/58.18

(58) Field of Search ..... 271/296, 298, 271/287, 288, 289, 290; 700/214, 213, 223; 270/58.01, 58.18, 58.19

(56) References Cited

U.S. PATENT DOCUMENTS 4,295,733 * 10/1981 Janssen et al. ..... 271/288 X
5,106,076 * 4/1992 Fujita et al. ..... 271/298 X
5,308,058 * 5/1994 Mandel et al. ..... 271/289
5,328,169 * 7/1994 Mandel ..... 271/298 X
5,390,910 * 2/1995 Mandel et al. ..... 271/296
5,551,686 * 9/1996 Sanchez et al. ..... 271/298
5,704,609 * 1/1998 Mandel et al. ..... 271/298 X
5,734,480 * 3/1998 Kawamura et al. ..... 271/298 X
5,752,697 * 5/1998 Mandel et al. ..... 271/298 X
5,777,882 * 7/1998 Salgado ..... 271/298 X
5,823,529 * 10/1998 Mandel et al. ..... 271/298 X
5,898,592 * 4/1999 Salgado et al. ..... 271/298 X

FOREIGN PATENT DOCUMENTS 07149470 6/1995 (JP) .
8-026572 * 1/1996 (JP) .

* cited by examiner

*Primary Examiner*—Christopher P. Ellis
*Assistant Examiner*—Patrick Mackey
(74) *Attorney, Agent, or Firm*—McDermott, Will & Emery

(57) ABSTRACT

A sheet sorting apparatus capable of changing the discharge priority bin in accordance with the number of sheets. The sheet sorting apparatus discharges sheets from a specified discharge port into a corresponding bin. The bins are constructed so as to be readily removable, and the discharge priority bin is determined based on the estimated number of discharge sheets and the capacity of the bin.

15 Claims, 10 Drawing Sheets

SHEET SORTING APPARATUS AND SHEET SORTING METHOD

CROSS-REFERENCE TO RELATED APPLICATIONS

This application is based on Application No. HEI 11-147609 and No. HEI 10-196414 filed in Japan, the content of which is hereby incorporated by reference.

BACKGROUND OF THE INVENTION

1. Field of the Invention

The present invention relates to a sheet sorting method or apparatus and a sheet sorting method. In detail,the present invention relates to a sheet sorting method or apparatus connected with an image forming apparatus such as a printer, facsimile, copier and the like, or integratedly incorporated in an image forming apparatus beforehand.

2. Description of the Related Art

A sheet sorting apparatus is a device for sorting sheets and is provided with a plurality of bins so as to discharge sheets from a selected discharge port into a plurality of bins corresponding to the discharge ports. It is proposed that this sheet sorting apparatus can be connected with an image forming apparatus such as a printer, a facsimile, a copier and the like, or may be integratedly incorporated in an image forming apparatus beforehand.

A sheet sorting apparatus has been proposed which provides detachable bins to allow the number of sheets accommodatable in each bin to be suitably changed. However, simply providing detachable bins to allow the number of sheets accommodatable in each bin to be changed has various disadvantages from a practical standpoint.

SUMMARY OF THE INVENTION

An object of the present invention is to provide a novel sheet sorting method or apparatus having various advantages from a practical standpoint.

Specifically, a first object of the present invention is to provide a sheet sorting method or apparatus which allows the priority discharge bin to be changed in accordance with the number of sheets being discharged. For example, in a conventional sheet sorting apparatus, when the number of sheets exceeds the number of sheets that can be accommodated in the bin, the discharge priority of the consecutive sheets is automatically switched, but which bin this discharge priority is switched to is determined occupancy condition of the bins at that moment in time, and cannot be decided beforehand. For this reason, a user must perform the complex task of handling various discharged sheets separately in the search for his own sheets. In the sheet sorting apparatus of the present invention, if the number of sheets estimated to be discharged is known beforehand, a bin capable of accommodating the estimated number of sheets can be allocated the discharge priority thereby reducing the work of the user.

A second object of the present invention is to provide a sheet sorting method or apparatus which allows changing the discharge port corresponding to a bin so as to increase the quality of sheet stackability. For example, when a bin directly above a particular bin is removed, there are two vertical discharge ports capable of discharging sheets to the particular bin. In this instance, in a conventional sheet sorting apparatus, sheets are discharged from the discharge port used by the removed bin. A disadvantage arises in the method of selecting this discharge port in that the alignment of sheets in the bin is disrupted because of the increase in the distance the sheets discharged from this discharge port into the bin or onto the sheets already stacked in the bin. In the sheet sorting apparatus of the present invention, At first the discharge port for discharging to this particular bin is used, then the discharge priority is switched to the discharge port used by the removed bin when the number of sheets discharged via the first discharge port attains the number accommodatable by the bin, thereby improving the quality of sheet stackability.

A third object of the present invention is to provide a sheet sorting method or apparatus capable of discharging sheets to a bin set by each user, even when a selected discharge port is malfunctioned. In a conventional sheet sorting apparatus, a user must search for his own sheets because sheets are discharged to a bin which is not normally specified for use by the user. In the sheet sorting apparatus of the present invention, sheets are discharged to bins specified for each user even when a discharge port is malfunctioned, thereby reducing the work of the user.

These objects are attained by the sheet sorting apparatus of the present invention comprising:

- a body;
- a plurality of bins detachable from the body,said bins being to be discharged sheets;
- an acquisition device for acquiring an estimated number of discharged sheets;
- a bin detection device for detecting the removal of each bin;
- a calculation device for calculating the number of sheets accommodatable in each bin based on the detection result of the bin detection device; and
- a selection device for selecting the discharge priority bin from the plurality of bins based on the estimated number of discharged sheets and the calculated number of sheets accommodatable by the bin.

These objects are attained by the sheet sorting apparatus of the present invention comprising:

- a body;
- a plurality of discharge ports provided with the body;
- an acquisition device for acquiring information relating to a specification of the discharge port of the plurality of discharge ports;
- a determination device for determining whether or not sheets can be discharged to the specified discharge port; and
- a selection device for selecting a discharge port directly above the specified discharge port when the determination device determines that sheets cannot be discharged to the specified discharge port.

These objects are attained by the sheet sorting apparatus of the present invention comprising:

- a body;
- bins detachable from the body and provided for each discharge port; and
- a bin detection device for detecting the removal of each bin;
- an acquisition device for acquiring information specifying a discharge port;
- a determination device for determining whether or not a bin is installed a discharge port directly above the specified discharge port; and
- a selection device for selecting a discharge port directly above the specified discharge port when the determination device determines that the bin is not installed.

BRIEF DESCRIPTION OF THE DRAWINGS

These and other objects and features of the present invention will become apparent from the following description of the preferred embodiments thereof taken in conjunction with the accompanying drawings, in which:

FIG. 1(*b*) is a side view of FIG. 1(*a*) viewed from the right side;

FIG. 2(*b*) is a top view of the FIG. 2(*a*) viewed from the arrow b direction;

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Construction

Figure 1A:
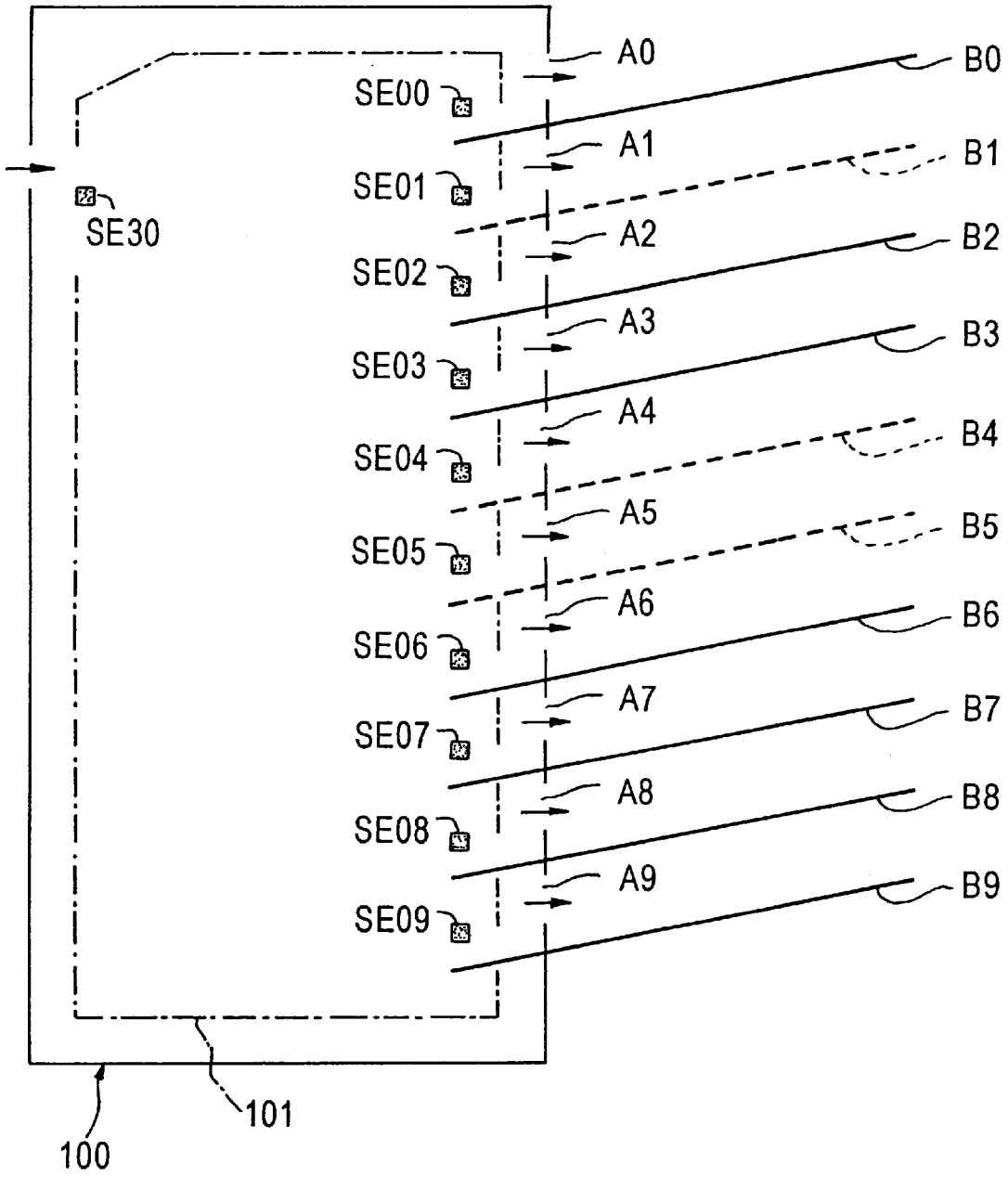
FIG. 1(*a*) is a schematic front view of a sorting apparatus 100 of the present embodiment.
Figure 1B:
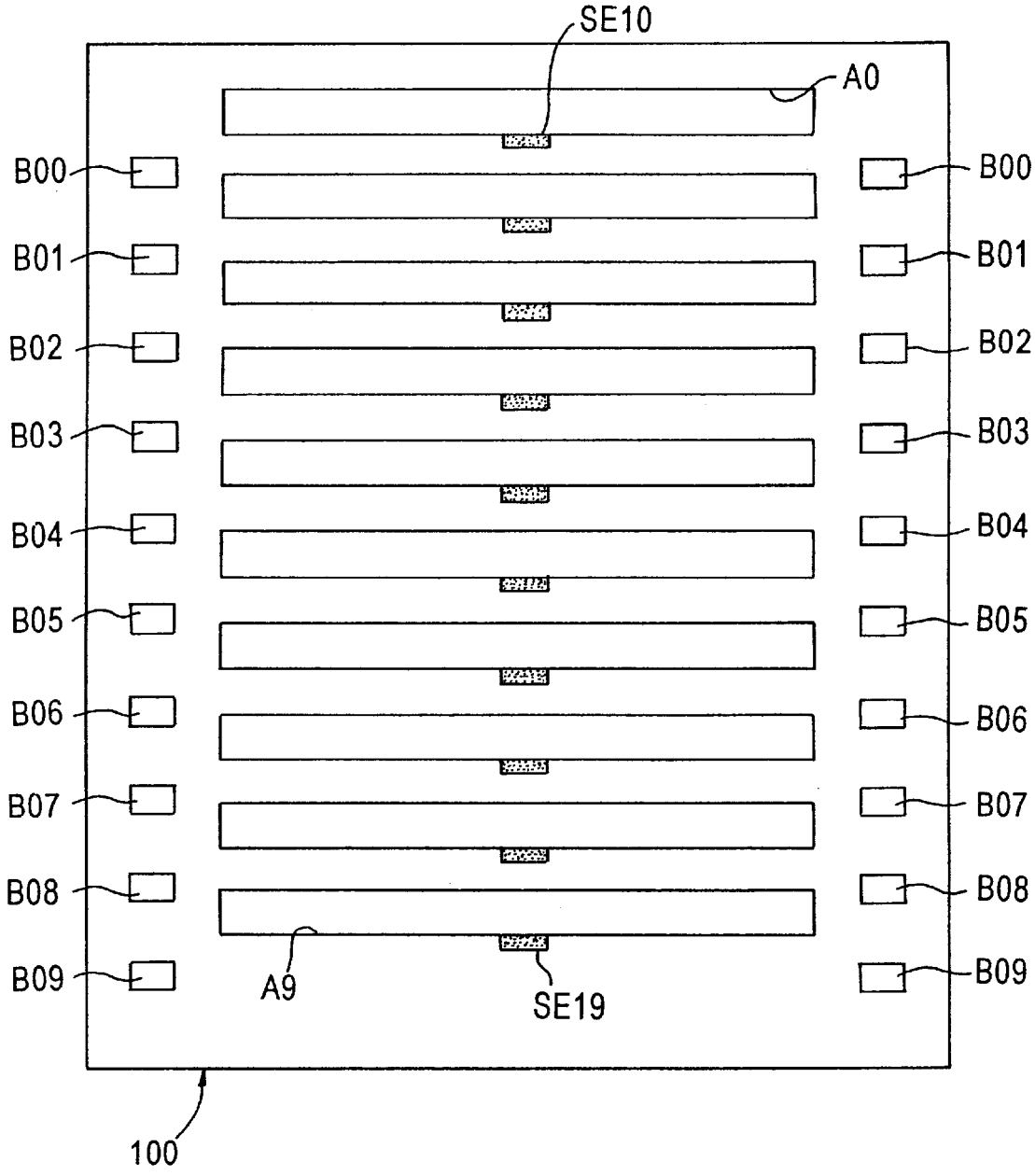
Figure 2A:
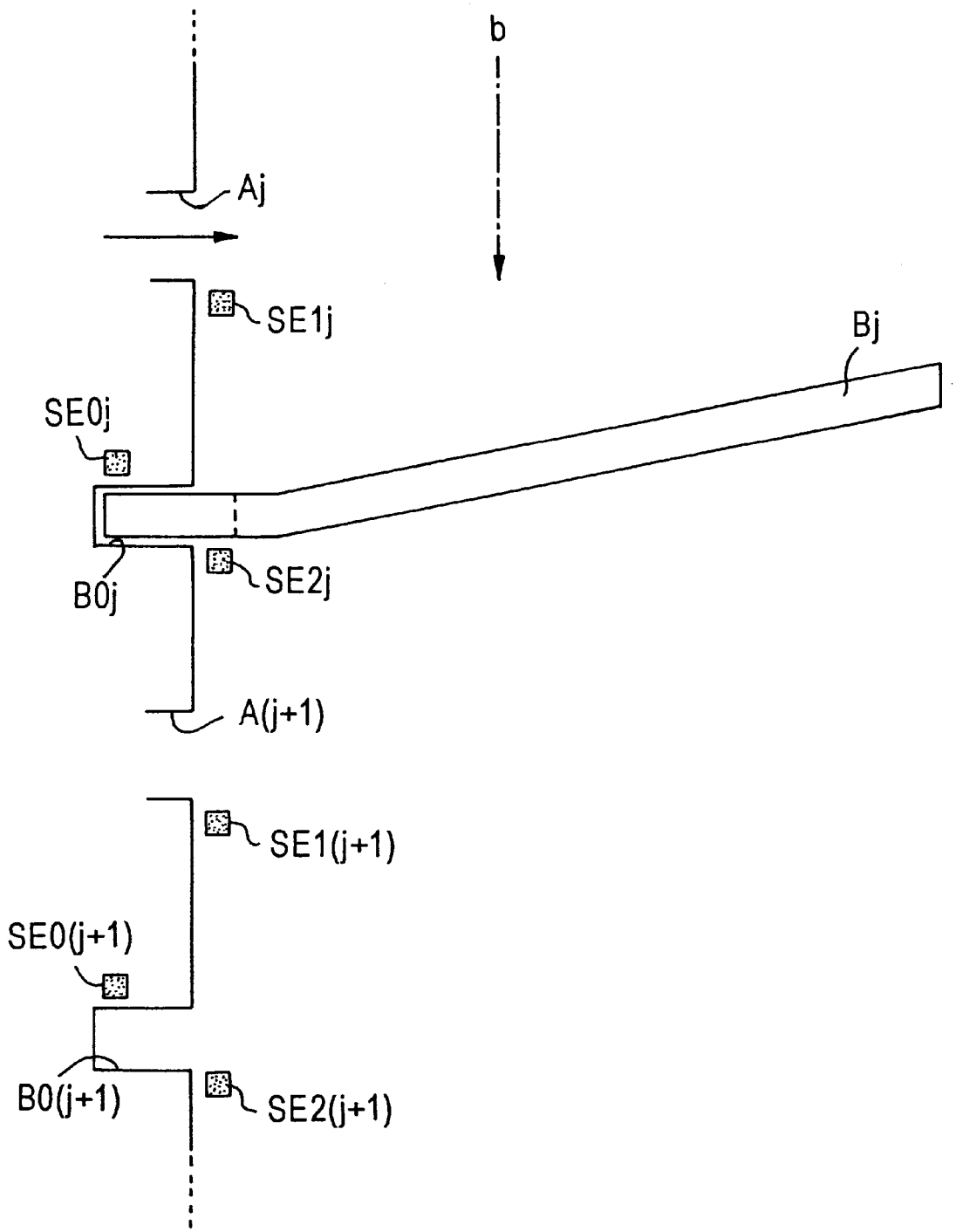
FIG. 2(*a*) is a section view along the arrow a—a line of FIG. 2(*b*) and shows an enlarged schematic view of the installation area of the bins Bj (j=0~9) of the sorting apparatus 100 of FIG. 1.
Figure 2B:
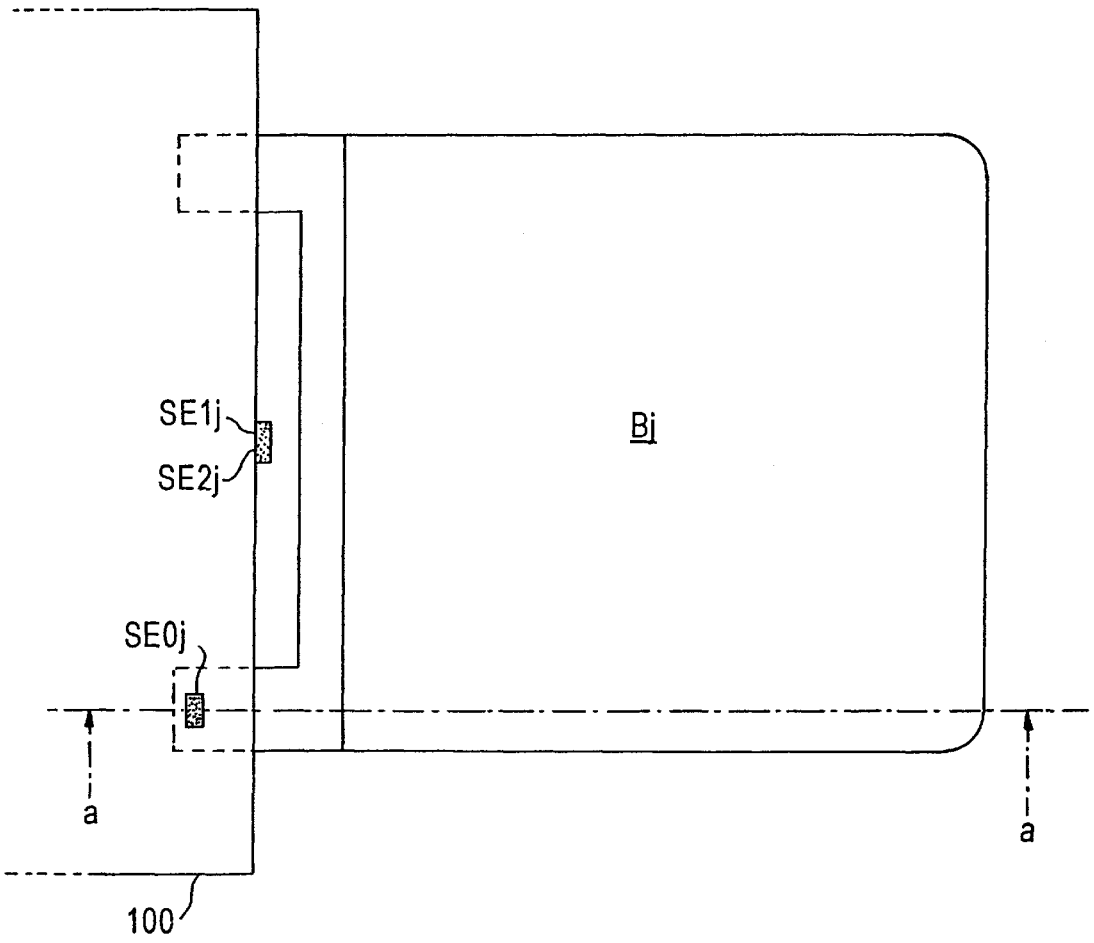

FIG. 1(*a*) is a front view of the sorting apparatus 100 of a sheet sorting apparatus, FIG. 1(*b*) is a side view of the sorting apparatus 100, FIG. 2(*a*) is an enlarged cross sectional view of the mounting part of the bins Bj (j=0~9) of the sorting apparatus 100, and FIG. 2(*b*) is an enlarged top view of the mounting part of the bins Bj (j=0~9) of the sorting apparatus 100.

Figure 4:
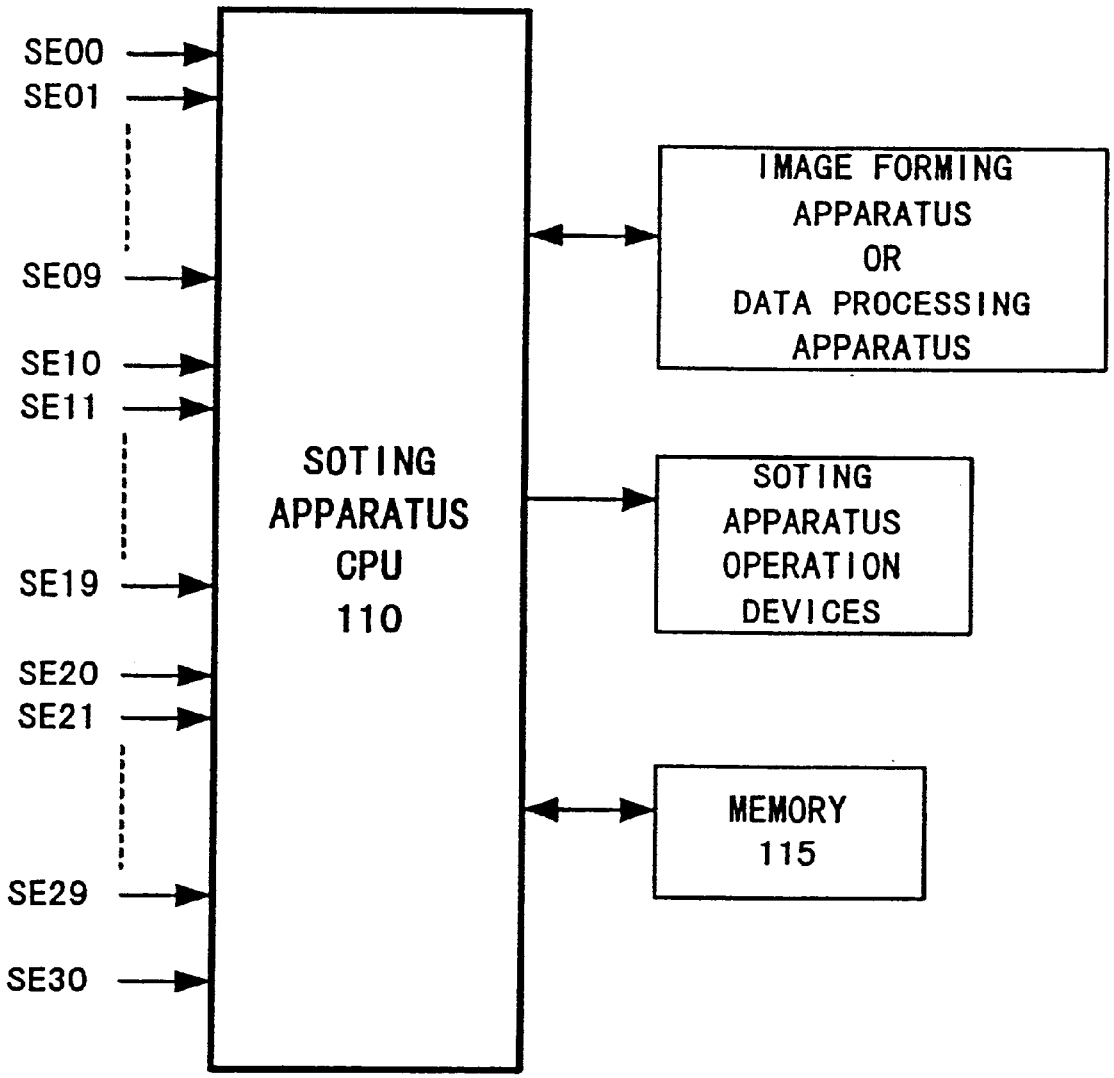
FIG. 4 is a block diagram showing the input or output of the controller of the sorting apparatus 100 of FIG. 1.

As shown in the drawings, the sorting apparatus 100 can accommodate 10 bins B0~B9, all of which are identical in shape, and each bin Bj is installed by inserting bilateral projections into the bin holder B0j (j=0~9) of the sorting apparatus 100. When the bins Bj are installed, the installed bins are detected by the sensors SEOj (j=0~9) provided adjacent to the bin holder B0j to detect the installed bins, and the detection data are input to the sorting apparatus CPU 110 (refer to FIG. 4). Reference number 101 refers to a transport or discharge mechanism provided within the sorting apparatus 100 to transport sheets and discharge the transported sheet to a selected discharge port. The sensor SE 30 is a sensor for detecting an arriving sheet fed to the sorting apparatus 100 from the image forming apparatus.

Discharge ports Aj (j=0~9) corresponding to the bins Bj are provided at positions directly above the bin holder B0j. Sensors SE1j (j=0~9) are provided near each discharge port Aj to detect when the number of sheets discharged from the discharge port Aj attains sheet capacity (an accommodatable number of sheets)of the bin. Sensors SE2j (j=0~9) are provided near the installation position of each bin Bj to detect the presence or absence of sheets in each bin. The detection signals of these sensors SE1j and SE2j are respectively input to the sorting apparatus CPU 110 (refer to FIG. 4).

When a random bin Bk (k is an integer from 0~8) is removed, sheets can be accommodated in the bin B (k+1) directly below the removed bin (sheet capacity of the bin B (k+1)+the sheet capacity of the bin Bk). In this instance, the discharge port selection method may be with method (I) or (II) below.

Method(I)

The selection method (I) initially uses the discharge port A (k+1) to discharge sheets to the bin B (k+1), and when the sensor SE1 (k+1) of the discharge port A (k+1) detects that the discharged sheet capacity has been attained, the discharge port is switched to the discharge port Ak used by the removed bin Bk.

Method(II)

The selection method (II) uses the discharge port Ak from the start.

The selection method (I) is advantageous in that it is difficult for the alignment of the sheets stacked in the bin to be disrupted because the falling distance of the sheet discharged from the discharge port into the bin or onto the stacked sheets is relatively small regardless of the number of removed adjacent bins. Accordingly, the method (I) may be used when many adjacent bins are removed. On the other hand, the selection method (II) is advantageous in that the controls are simpler than for the method (I). Accordingly, the method (II) may be used when it is unlikely that problems will arise when the falling distance is large, e.g., when the number of removed adjacent bins (for example 3 bins) is restricted beforehand.

The selection methods (I) and (II) are described below with reference to FIG. 5. The method (I) is effective as a sequence when discharge is permitted (step S02: NO in FIG. 5) and the selected discharge port is not malfunctioned. The method (II) is effective as a sequence to avoid reducing the number of dischargeable sheets of the entire sheet sorting apparatus even when discharge is not permitted (step S02: YES in FIG. 5) when a selected discharge port is malfunctioned.

Figure 3:
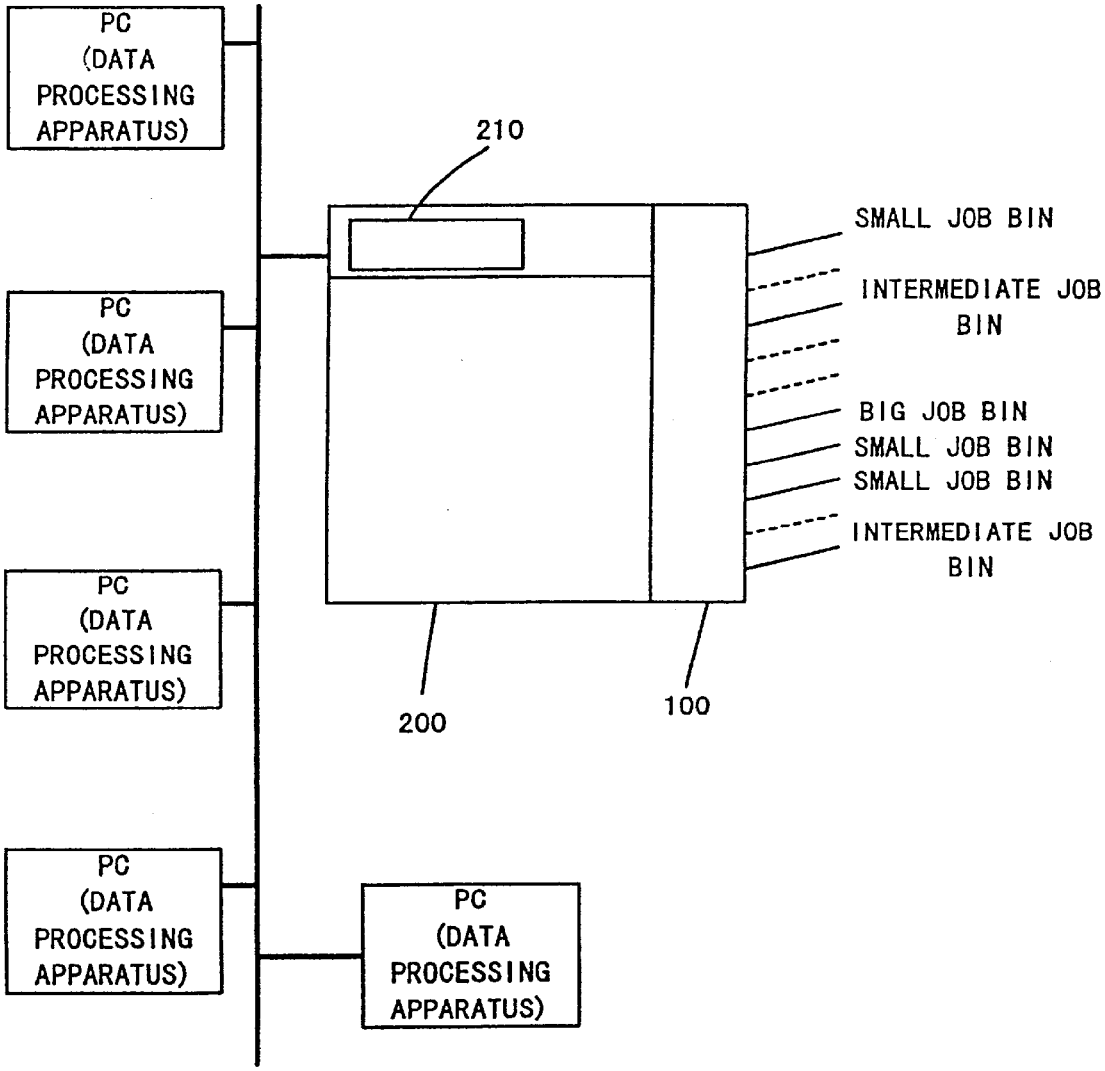
FIG. 3 illustrates the network environment of a printer 200 provided with the sorting apparatus 100 of FIG. (1)

FIG. 3 shows a network environment capable of printing when a plurality of personal computers (a data processing apparatus)and a printer 200 (an image forming apparatus)are connected via wiring, and print data are transmitted from any personal computer to the printer 200. As shown in FIG. 3, the sorting apparatus 100 of FIG. 1 is connected with or integratedly incorporated in the printer 200 in a network environment. The sorting apparatus 100 also may be connected with or integratedly incorporated in a single printer, copier, or facsimile. Either of the methods (III) or (IV) described below may be used to acquire information on the specified bin and number of estimated discharged sheets from the sorting apparatus 100 installation environment.

Method(III)

The acquisition method (III) acquires information of the specified bin and number of estimated discharged sheets via input from the operation panel 210 when, for example, the sorting apparatus is connected with a single printer.

Method(IV)

The acquisition method (IV) acquires information on the specified bin and number of estimated discharged sheets from a personal computer when, for example, the sorting apparatus is connected with a printer in a network environment.

Either of the acquisition methods (III) and (IV) can use the selection methods (I) and (II) as a discharge port selection method.

Operation

The operation of the sorting apparatus 100 is described below with reference to the flow chart showing the control of the sorting apparatus CPU 110. FIG. 5 shows an example of a discharge port selection sequence in the bin specification information acquisition method (IV). The sequence of FIG. 5 starts when the sensor SE 30 detects a sheet, or by the reception of information relating to the feeding of a sheet from the image processing apparatus such as a printer. According to the sequence of FIG. 5, the CPU 110 selects the discharge port for each sheet.

First, information specifying the discharge port (or bin) is received from the printer or personal computer (SO1). When a discharge port (or bin) is not specified by the printer or personal computer, a predetermined initialization value is fetched. Then, insofar as the specified discharge port (current discharge port) Ak is not malfunctioned (S02: NO), and when the sensor SE1k of the specified discharge port detects that the sheet capacity has not been attained (S03: NO), the specified discharge port Ak is selected. Then, the sheet is discharged from the specified discharge port Ak (S04). The determination as to whether or not the specified discharge port is malfunctioned is accomplished via information specified by the operation panel 210 (refer to details in FIG. 8).

On the other hand, when the specified discharge port Ak is malfunctioned (S02: YES), or the specified discharge port Ak has attained the sheet capacity (S03: YES), it is determined that the bin B(k−1) corresponding to the discharge port A (k−1) directly above the discharge port Ak is detached. When the bin (k−1) is not installed (S05: NO), for example, when the capacity of the bin B(k) corresponding to the discharge port A (k) is greater than normal, the discharge can continue to the to the bin, and the discharge port A (k−1) directly above the current discharge port Ak is specified as the new discharge port (S06), and the routine continues to S02. In this way, the same process is executed for the discharge port A (k−1), and sheets are discharged from the discharge port A (k−1). (S04).

When the bin B (k−1) is not installed (S05:NO), the current discharge port Ak is malfunctioned. That is, by removing the bin (k−1) directly above, the discharge port A (k−1) directly above is specified as the new discharge port (S06), and the routine continues to step S02). In this way, sheets are discharged to the selected bin Bk, without reducing the number of dischargeable is sheets of the entire sheet sorting apparatus.

When the bin B (k−1) corresponding to the discharge port A (k−1) directly above the current discharge port Ak is installed (S05: YES), a discharge port selected in accordance with a predetermined selection rule is set as the specified discharge port (S08), and the routine continues to S02. In this way, the newly specified discharge port is subject the identical process and sheets are discharged from this discharge port (S04). The predetermined selection rule is applicable (S07: YES). The predetermined selection rule is a rule, for example, which selects the bin at the uppermost position among the empty bins.

When the predetermined selection rule cannot be applied in step S07, for example, when there is no empty bin (S07: NO), the discharge port cannot be selected, and for this reason an alert is transmitted to the printer, and either displayed on the printer operation panel 210, or an alert is transmitted to the personal computer and displayed on the computer display (S09). Then, the user is invited to remove the sheets from the bin. When this process can be accomplished within a predetermined time (S10: YES), the routine returns to step S01. When this process cannot be accomplished before a predetermined time period has elapsed, this information is transmitted to the printer or the personal computer. In this way, the unused print information or unprinted image data can be saved in the memory of the printer or the personal computer.

Figure 6:
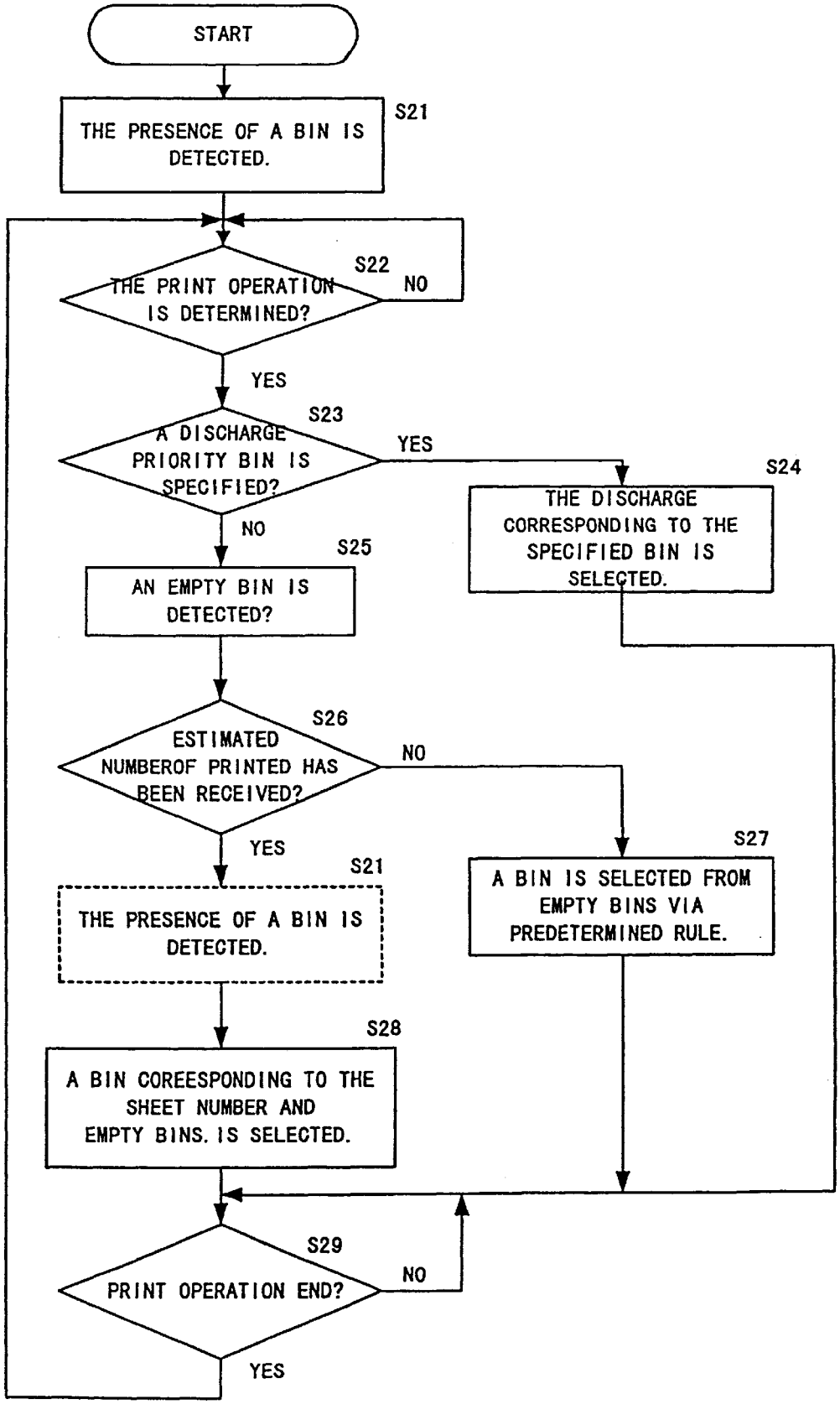
FIG. 6 is a flow chart showing the sequence for allocating the discharge ports in accordance with the presence or absence of printed sheet number information and the presence or absence of bin specification, and the detachment of bins performed by the sorting apparatus CPU 110.

FIG. 6 is a flow chart showing the control executed by the sorting apparatus CPU 110, and this control is described below. FIG. 6 shows the control for selecting a bin corresponding to a bin specification or an estimated print number. The selection of the discharge port corresponding to the selected bin may be accomplished via either method (I) or (II). The acquisition method for acquiring information of the specified bin and estimated number of sheets may be either method (III) or (IV).

First, the presence of a bin for each bin holder Aj is detected, and the detection information is stored in memory (FIG. 4, 115) (S21). Then, the presence or absence instructions for the print operation is determined (S22). The instructions for the print operation are input via the operation panel 210, or specified from a personal computer on the network.

When a discharge priority bin is specified by print instruction (S23: YES), the discharge port corresponding to the specified bin is selected (S24). When the attainment of the bin sheet capacity is detected from the discharge port during discharge, and the bin directly above the current bin is not installed, a process may be executed to change the discharge port to the discharge port directly above the current discharge port.

When a discharge priority bin is not specified (S23: NO), an empty bin is detected based on the detection result of the sensor SE2j (j=0~9) (S25). Then, a determination is made as to whether or not the estimated number of printed sheets has been received via the print information. When this information has not been received,(S26: NO), a bin is selected from among the empty bins via a predetermined rule, and the discharge port corresponding to the selected bin is selected (S27). For example, the uppermost empty bin is selected.

When the estimated number of printed sheets is received in step S26 (S26: YES), a bin corresponding to the estimated sheet number is selected, and the discharge port corresponding to the selected bin is selected (S28). For example, when the estimated number of sheets are few, a small job bin (the bin directly above the current bin in FIG. 3) is selected. When the estimated number of sheets is larger than normal, the intermediate job bin (the bin directly above the removed bin in FIG. 3) is selected. When the estimated number of sheets is very large, the big job bin (the bin directly above the bin directly above the removed bin in FIG. 3) is selected. The discharge port corresponding to the selected bin is selected. The method of selecting the discharge port corresponding to the selected bin may be either method (I) or (II). The bin detachment detection for each bin holder Aj may be stored (S21).

The selected discharge port is maintained until the continuous print operation ends, and when the continuous print operation ends (S29 : YES), the routine returns to step S22, and the sorting apparatus enters the standby state awaiting instructions on the next print operation. Although the processing has been described in terms of when detecting when the number of sheets discharged from a selected discharge port attains the bin capacity, a bin may be selected from among empty bins in accordance with a predetermined selection rule as in conventional methods.

Figure 5:
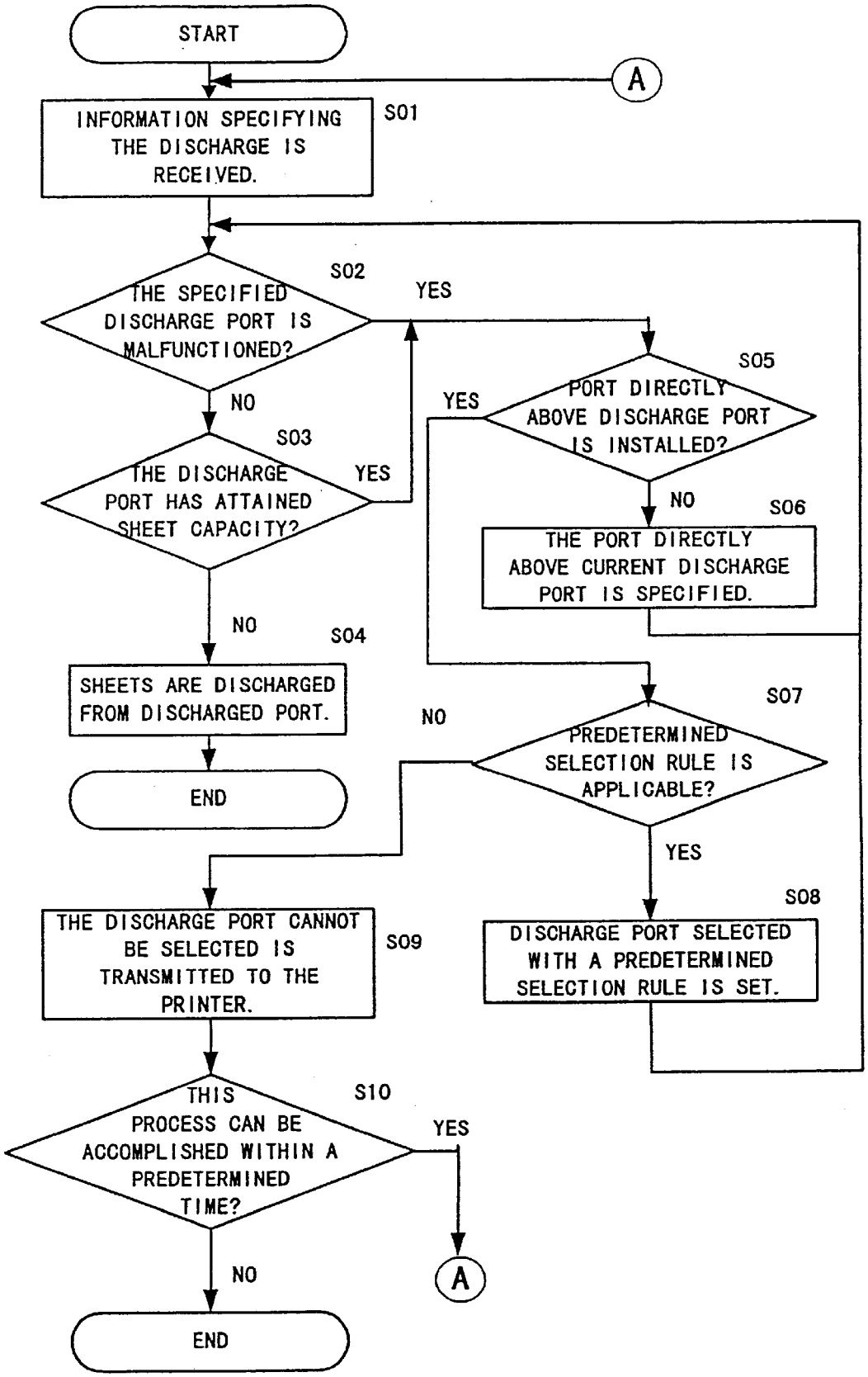
FIG. 5 is a flow chart showing the discharge port selection sequence for each sheet by the sorting apparatus CPU 110.
Figure 7:
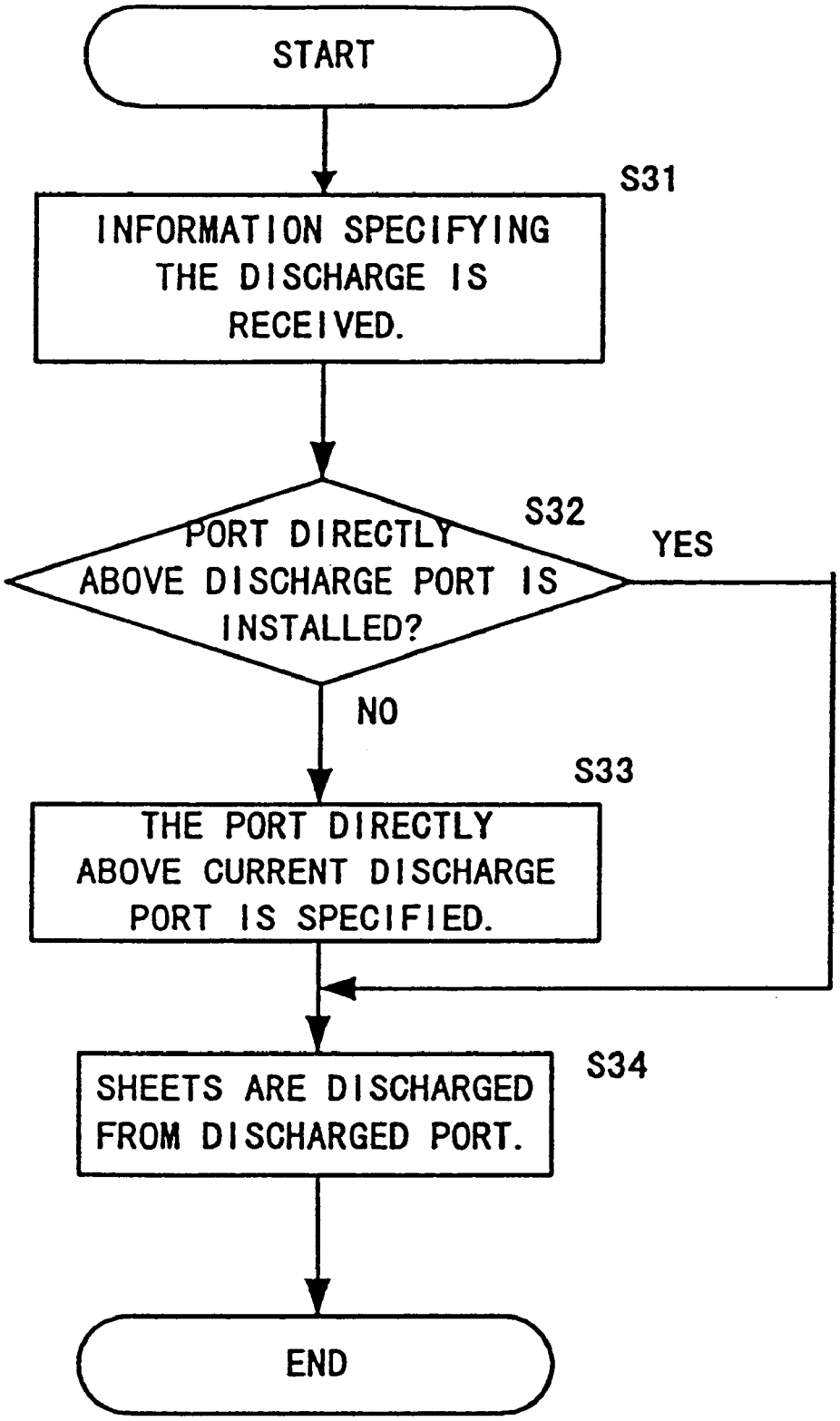
FIG. 7 is a flow chart showing examples of the discharge port selection sequence for each sheet via the sorting apparatus CPU 110.

FIG. 7 shows an example using the discharge port selection sequence of method (II) in method (IV) (for specifying a bin or discharge port) shown in FIG. 5. In this sequence, the installation of the bin directly above the specified discharge port is detected, and is the bin is detached, the sheets are dischargeed from this discharge port directly above the current bin.

First, information specifying the discharge port (or bin) is received (S31). When there is no discharge port (or bin) specification received from the printer or personal computer, a default value is received. Then, a determination is made as to the installation of a bin B (k−1) corresponding to the discharge port A (k−1) directly above the current discharge port Ak. When the bin B (k−1) is not installed (S32: NO), for example, when the bin B has been removed because sheets cannot be discharged due to blockage of the discharge port AK, the discharge port A (k−1) directly above the current discharge port Ak is set as the newly specified discharge port(S33). In this way, sheets are discharged from the discharge port A (k−1) (S34). When the bin B (k−1) is installed (S32: YES), the sheets are dischargeed from the specified discharge port Ak (S34).

Figure 8:
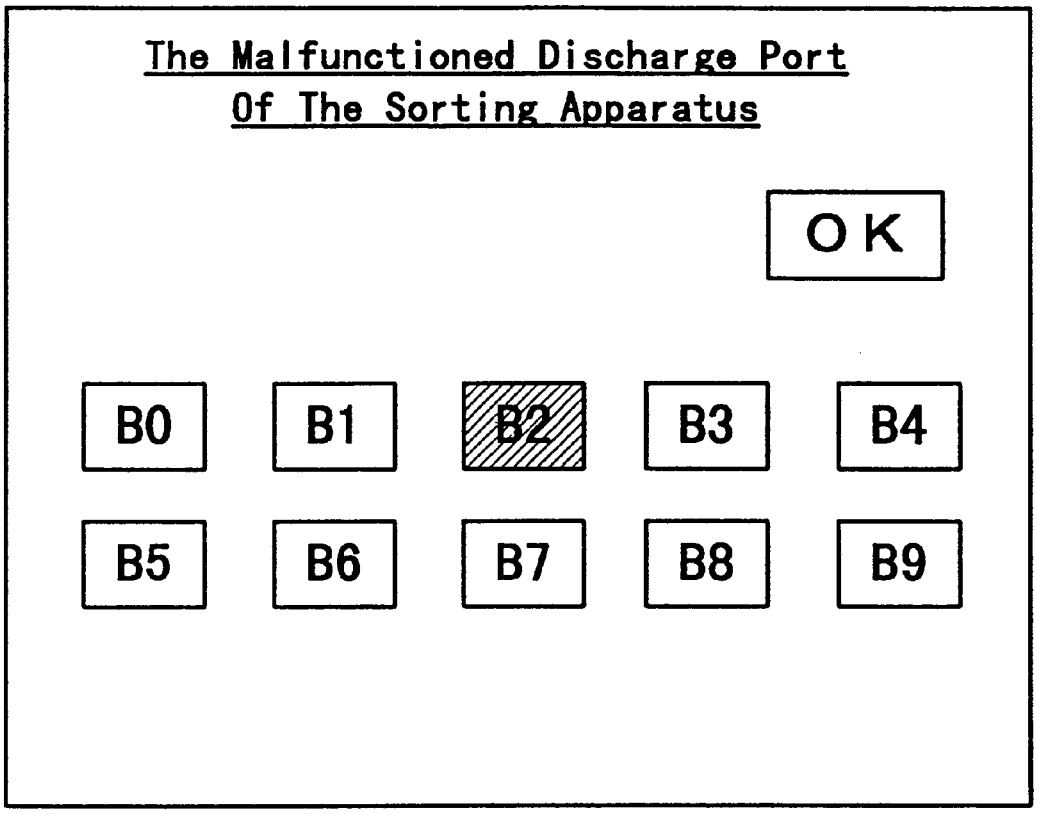
FIG. 8 shows the operation panel 210 for specifying the malfunctioned discharged port of the sorting apparatus.

FIG. 8 shows the screen specifying the malfunctioned discharge port of the sorting apparatus displayed on the operation panel 210 disposed on the front side of the printer 200 shown in FIG. 3. This screen specifies the malfunctioned discharge port by the user. The display shown in FIG. 8 indicates that the discharge port corresponding to the bin B2 is malfunctioned. That is, the blockage location specified on the screen is used to determine whether or not the specified discharge port is malfunctioned in step S02 of FIG. 5.

The sheet sorting apparatus of the present embodiment is provided with readily removable bins, and allows the discharge priority bin to be changed in accordance with the number of sheets to be discharged. The sheet sorting apparatus of the present embodiment is capable of changing the discharge port relative to a bin, so as to improve the sheet stacking quality. The sheet sorting apparatus of the present embodiment is capable of discharging sheets to a bin determined for each user even when a selected discharge port is malfunctioned.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A sheet sorting apparatus comprising:

a body;

a plurality of bins detachable from the body, said plurality of bins being to accommodate discharge sheets;

an input device for inputing an estimated number of sheets to be discharged via said plurality of bins;

a bin detection device for detecting each bin of the plurality of bins that has been removed;

a device for determining number of sheets that can be accommodated in each unremoved bin based on the detection result of the bin detection device; and a selection device for selecting a discharge priority bin from the plurality of bins based on the inputted estimated number of discharged sheets and the determined number of sheets that can be accommodated in said each unremoved bin.

2. The sheet sorting apparatus claimed in claim 1, wherein the estimated number is input from a data processing apparatus connected to an image forming apparatus feeding sheets to the sheet sorting apparatus.

3. The sheet sorting apparatus claimed in claim 1, further comprising:

a discharge device for discharging a sheet into the bin selected by the selection device.

4. A sheet sorting apparatus comprising:

a body;

a plurality of discharge ports provided with the body;

an input device for inputting information relating to a specified discharge port of plurality of discharge ports;

a determination device for determining whether or not sheets can be discharged from the specified discharge port; and a selection device for selecting a discharge port directly above the specified discharge port when the determination device determines that sheet cannot be discharged from the specified discharge port.

5. The sheet sorting apparatus claimed in claim 4, further comprising:

a plurality of bins, each provided corresponding to a respective discharge port, said each bin being detachable from the body; and a bin detection device for detecting the removal of said each bin;

wherein the determination device determines whether or not a bin is provided corresponding to the selected discharge port; and the selection device selects a discharge port directly above the specified discharge port when it is determined by the determination device that a bin is not provided.

6. The sheet sorting apparatus claimed in claim 4, further comprising:

a detection device provided for each discharge port for detecting that the sheets discharged from the discharge port attain a predetermined bin capacity with respect to the specified discharge port;

wherein the determination device determines sheets cannot be discharged from the specified discharge port when the discharged sheets the predetermined bin capacity.

7. The sheet sorting apparatus claimed in claim 4, wherein the determination device determines sheets cannot be discharged from the specified discharge port when the specified discharge port has malfunctioned.

8. The sheet sorting apparatus claimed in claim 4, wherein the estimated number is input from a data processing apparatus connected to an image forming apparatus feeding sheets to the sheet sorting apparatus.

9. The sheet sorting apparatus claimed in claim 4, further comprising:

a discharge device for discharging a sheet from the port selected by the selection device.

10. A sheet sorting apparatus comprising:

a body provided with a plurality of discharge ports;

bins detachable from the body and each bin provided corresponding to a respective discharge port; and a bin detection device for detecting the removal of each bin;

an input device for inputting information relating to a specified-discharge port of plurality of discharge ports;

a determination device for determining whether or not a bin is provided for a discharge port directly above the specified discharge port; and a selection device for selecting the discharge port directly above the specified discharge port when the determination device determines that the bin is not provided.

11. The sheet sorting apparatus claimed in claim 10, wherein the estimated number is input from a data processing apparatus connected to an image forming apparatus feeding sheets to the sheet sorting apparatus.

12. The sheet sorting apparatus claimed in claim 10, further comprising:

a discharge device for discharging a sheet from the port selected by the selection device.

13. A sheet sorting method comprising the steps of:

inputting an estimated number of sheets to be discharged;

detecting a removal of any one of a plurality of detachable bin;

determining a number of sheets that can be accommodated in each unremoved bin based on the detection result;

selecting a discharge priority bin from the plurality of bins based on the estimated number of sheets to be discharged and the determined number of sheets that can be accomodated in said each unremoved bin.

14. A sheet sorting method comprising the steps of;

inputting information relating to a specified discharge port;

determining whether or not sheets can be discharged from the specified discharge port;

selecting a discharge port directly above the specified discharge port when a sheet cannot be discharged from the specified discharge port;

selecting a discharge port directly above the specified discharge port when sheets cannot be discharged to the specified discharge port.

15. A sheet sorting method comprising the steps of;

detecting a removal of any one of a plurality of detachable bins;

inputting information relating to a specified discharge port;

determining whether or not a bin is provided for a discharge port directly above the specified discharge port; and selecting the discharge port directly above the specified discharge port when the step of determining determines that the bin is not provided for the discharge port directly above the specified discharge port.

* * * * *